US006079168A

United States Patent [19]

Shaver

[11] Patent Number: 6,079,168

[45] Date of Patent: Jun. 27, 2000

[54] PARTIALLY TRANSPARENT STORM SHUTTER

[76] Inventor: D. Scott Shaver, 14522 SW. 75th St., Miami, Fla. 33183

[21] Appl. No.: 09/059,362

[22] Filed: Apr. 14, 1998

Related U.S. Application Data

[60] Provisional application No. 60/043,276, Apr. 17, 1997.

[51] Int. Cl.[7] ..... E06B 3/30

[52] U.S. Cl. ..... 52/202; 52/798.1; 49/61; 49/464

[58] Field of Search ..... 52/202, 203, 798.1, 52/235, 200; 49/61, 62, 463, 464

[56] References Cited

U.S. PATENT DOCUMENTS

| | | | |
|---|---|---|---|
| 4,333,271 | 6/1982 | DePaolo et al. . | |
| 4,562,666 | 1/1986 | Young, III | 49/62 |
| 4,685,261 | 8/1987 | Seaquist . | |
| 5,228,238 | 7/1993 | Fenkell . | |
| 5,345,716 | 9/1994 | Caplan | 49/61 |
| 5,383,315 | 1/1995 | Birs . | |
| 5,426,893 | 6/1995 | Hoffman . | |
| 5,457,921 | 10/1995 | Kostrzecha . | |
| 5,560,164 | 10/1996 | Ahrens | 52/202 |

*Primary Examiner*—Beth A. Aubrey
*Assistant Examiner*—Brian E. Glessner
*Attorney, Agent, or Firm*—Bacon & Thomas PLLC

[57] ABSTRACT

A partially transparent storm shutter for protecting glass windows, doors, and similar building openings from damage due to wind forces and wind driven flying objects is formed of a plurality of adjacent corrugated sheet metal and transparent protective, impact resistant sheet panels rigidly connected together along their respective adjacent edges. Special connector members are utilized to connect the transparent panel or panels to the corrugated sheet metal panel(s) and special connector members may be utilized to connect together adjacent transparent panels used in the storm shutter. The transparent panels may be formed of tough, impact resistant, polycarbonate plastic sheet material.

2 Claims, 3 Drawing Sheets

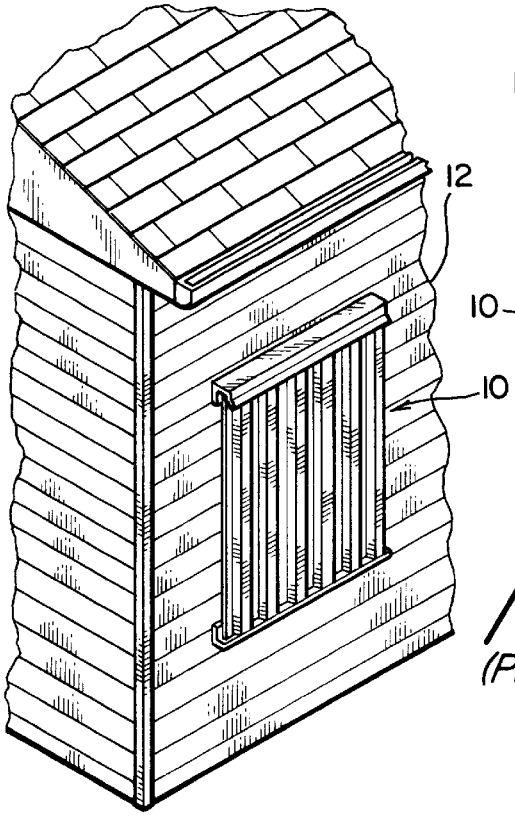
FIG. 1
(PRIOR ART)
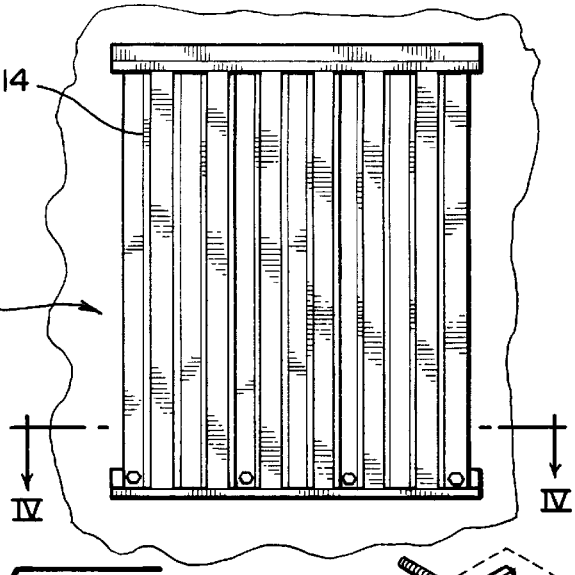
FIG. 2
(PRIOR ART)
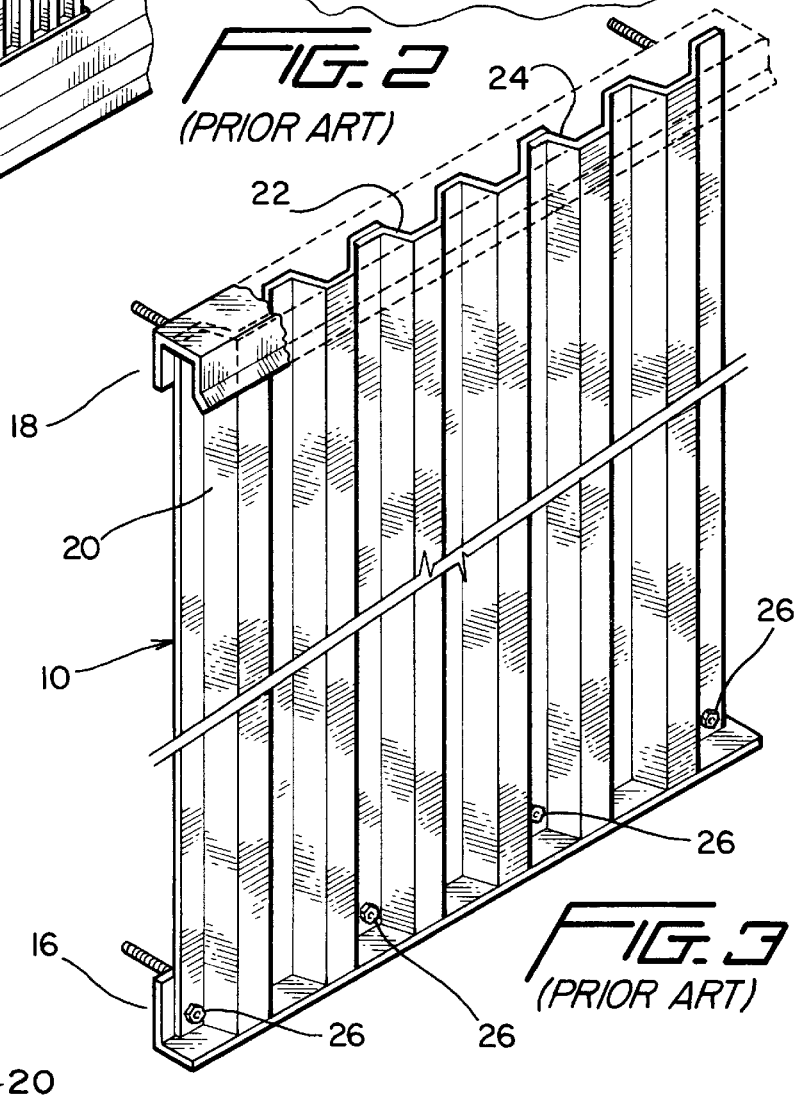
FIG. 3
(PRIOR ART)
FIG. 4
(PRIOR ART)
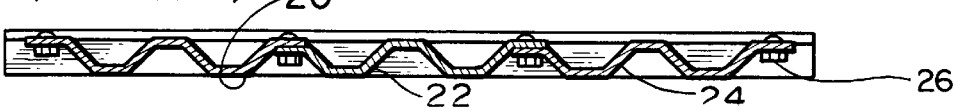

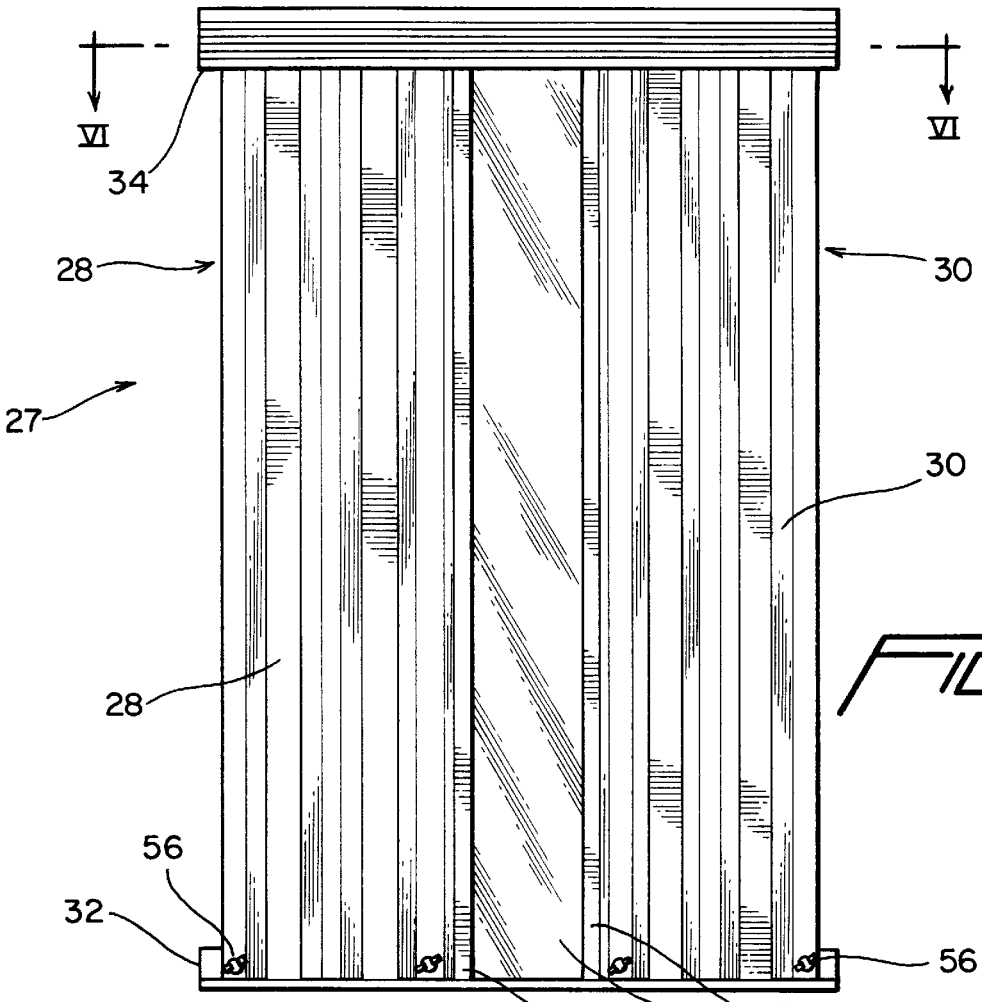
FIG. 5
FIG. 6
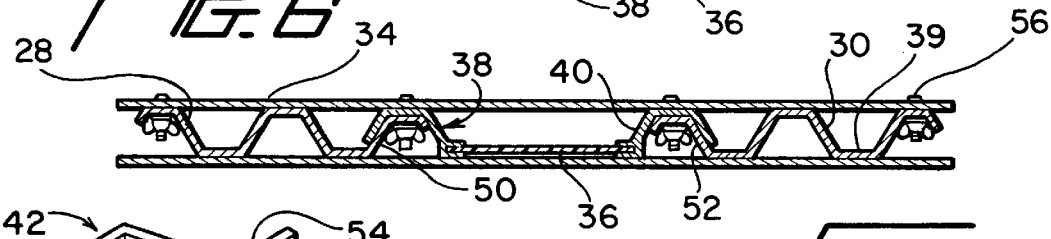
FIG. 8
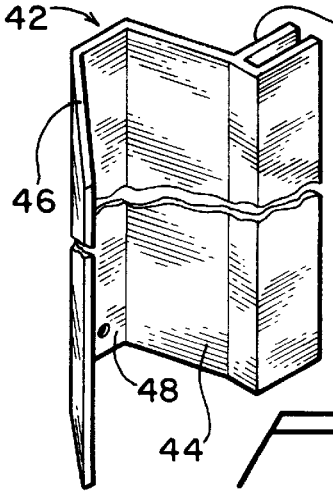
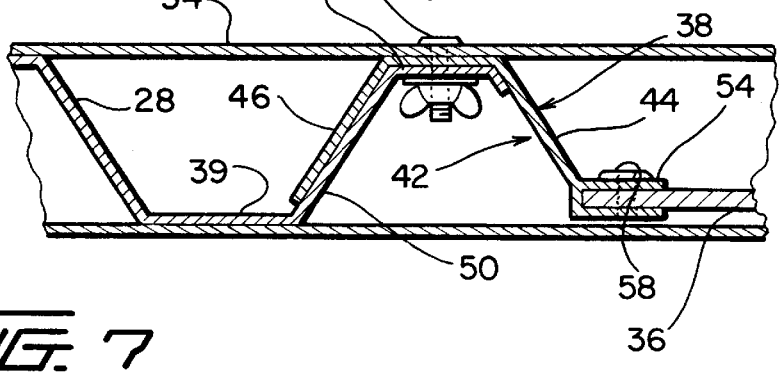
FIG. 7

PARTIALLY TRANSPARENT STORM SHUTTER

This application Ser. No. 09/059,362 claims priority from provisional application Ser. No. 60/043,276 filed on Apr. 17,1997.

BACKGROUND OF THE INVENTION (A) Field of the Invention

This invention relates to storm shutters adapted to protect glass windows, doors and similar openings in buildings against damage from wind forces and wind driven debris.

(B) Discussion of Related Art

Storm shutters intended to protect glass windows, doors and similar openings in buildings against high velocity winds and wind driven debris have been recently developed for use in coastal and other areas subjected to meteorological disturbances such as hurricanes, tornados and similar events that expose building structures to high velocity winds and debris driven by such winds.

It is highly desirable to protect such glass covered openings against breakage to minimize damage to the interior of the building that would otherwise occur as a result of wind generated internal pressures within the structure and wind driven rain.

More recently, local governments have enacted regulations governing the building of structures in hurricane prone geographic areas mandating that various building components, including shutters, meet minimum specifications governing strength, impact resistance, shatter resistance and load bearing ability. Storm shutter, like other building components subject to such mandates, must be capable of meeting such specifications while at the same time preserving structural features that enhance the commercial marketability of such shutters.

It is important that such shutter system be relatively light weight and easy to handle by a homeowner or business proprietor; be resistant to deterioration from outside weather, including sunlight; and be easily installed and removed over the useful life of the shutter.

One form of shutter that has enjoyed commercial acceptance is illustrated in U.S. Pat. No. 4,333,271 granted Jun. 8, 1982. In accordance with the shutter system described in the patent, corrugated panels of metal are retained on the outside of a building opening such as a glass window or doorway by a sill member extending along the bottom of the shutter and a channel-like header unit that receives the upper ends of the panels. Installation of such a shutter is simply a matter of sliding individual corrugated panels upwardly into the header and fastening them at their bottom ends to the sill area. The corrugated panels nest together along adjacent corrugations to provide a structural panel capable of resisting winds and wind driven debris that would otherwise impact a window or door protected by the shutter.

A problem with this type of shutter, of course, is that, once installed, passage of light through the window or door is blocked. The interior of the building is rendered dark and, in the event of a power failure that often occurs during meteorological disturbances, the interior of the building becomes dark and inhospitable. Also, the opaque storm shutter prevents occupants from observing their surroundings outside the building which raises the anxiety level of the building occupants before, during and after a disturbance.

Prior art attempts have been made to make such a storm shutter transparent to enable viewing through a door or window to be protected and such an example is described in U.S. Pat. No. 5,457,921 granted Oct. 17, 1995. This type of shutter is constituted of corrugated transparent plastic panels attached to each other and to the framework of a window or other opening to be protected. However, it has been observed that such shutters also have disadvantages due to the large expanses of synthetic resin panels utilized and the manufacturing cost of producing corrugated sheets of impact resistant, weather resistant transparent plastic that is sufficiently rigid to meet all specifications applicable to storm shutters.

Other storm shutter systems are described in the following patents:

| Pat. No. | Issue Date |
|---|---|
| 4,685,261 | August 11, 1987 |
| 5,228,238 | July 20, 1993 |
| 5,345,716 | September 13, 1994 |
| 5,383,315 | January 24, 1995 |
| 5,426,893 | June 27, 1995 |

BRIEF SUMMARY OF THE INVENTION

The present invention has as a primary objective the provision of a partially transparent storm shutter that is impact and shatter resistant and sufficiently rigid so as to protect a glass window, door or similar opening in a building.

In its simplest form, the invention comprises a plurality of adjacent, laterally spaced, corrugated sheet metal panels and, transparent impact resistant protective sheet panels rigidly and continuous connected together along their respective adjacent edges.

The invention also provides a unique connector member for joining transparent protective sheet panels to corrugated sheet metal panels to form a storm shutter or to connect such transparent protective sheet panels together to form the shutter.

In a preferred embodiment, the connector member is an extruded profile that includes a main body portion and a side portion or edge wherein the main body portion is bent or curved away from the plane of the transparent panel to be retained by the connector member, and the side portion or edge is shaped to receive the transparent panel along a rigid connection.

A plurality of connector members may be fitted in contiguous, nested relationship and fastened together to connect the transparent protective panels or the connector member may be configured so as to extend between the edges of the transparent protective sheet panels and an adjacent corrugated sheet metal panel. In this latter embodiment, the main body of the connector member is configured so that it fits closely over the corrugation of the adjacent corrugated sheet metal panel to provide a reinforcement against structural deflection of the panel and connector system.

The inventive storm shutter provides a transparent protective sheet panel within the shutter system that enables the occupants to view their surroundings outside a structure on which the shutter is installed and permits entry of ambient light into the structure while the shutter is installed on the exterior of the structure.

Provided that the transparent protective sheet panel is sufficiently rigid to resist wind loads and impact loads from wind driven objects, the connector members utilized to retain the transparent panels will provide a rigid joint structure that further reinforces the transparent panel and will connect the transparent panel structurally to the adjacent structure, which may be a corrugated sheet metal panel, for example, or another transparent panel.

BRIEF DESCRIPTION OF THE DRAWINGS

With reference to the appended drawings:

FIG. 1 illustrates a corrugated metal storm shutter installed over a window of a building in accordance with known prior art;

FIGS. 2 and 3 are elevation and isometric views, respectively, of the corrugated metal storm shutter illustrated in FIG. 1;

FIG. 4 is a section view taken along line IV—IV in FIG. 2;

FIG. 5 is an elevation view of a partially transparent storm shutter constructed in accordance with the present invention;

FIG. 6 is a section view taken along line VI—VI in FIG. 5;

FIG. 7 is an isometric view of a connector member in accordance with the present invention;

FIG. 8 is an enlarged detail of the view illustrated in FIG. 6 showing the connector member;

DETAILED DESCRIPTION OF PREFERRED EMBODIMENTS OF THE INVENTION

Figure 9:
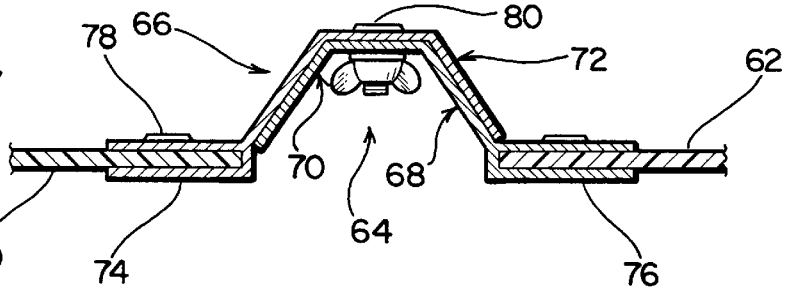
FIGS. 9–11 are representative sectional views taken through a pair of spaced apart transparent panels rigidly connected together along adjacent edges by a pair of connector members in accordance with an alternate embodiment of the invention.

With reference to FIGS. 1–4, an example of a corrugated sheet metal storm shutter 10 constructed in accordance with known prior art is illustrated as covering a window opening (located behind the storm shutter 10) of a building 12. The storm shutter 10 comprises one or more connected corrugated metal sheets with vertically oriented corrugations 14. The corrugations 14 of the storm shutter 10 are transversely spaced across the shutter width, as shown in FIGS. 3 and 4.

Typically, in accordance with the prior art, a sill member 16 is affixed to the building 12 adjacent the lower end of the window or opening to be protected and a header member 18 likewise is secured to the building at the top end of the opening to be protected. The corrugated panel (or panels if more than one sheet is used) 10 is then inserted upwardly into the header member 18 and secured along its lower edge to the sill member 16. Thus, the panel 10 may be conveniently removed from the window or other opening by releasing the fasteners securing it to the sill member 16 and pulling it away from the header member 18, leaving the sill member 16 and the header member 18 fastened to the building. Of course, the sill member 16 and header member 18 may be entirely removed from the building, if desired, although these members are typically retained on the building to enable quick installation of the corrugated panels or panel 10.

As shown in FIGS. 3 and 4, the shutter 10 may be made up of multiple corrugated panels 20,22,24,etc. that are inserted at their upper ends into the header member 18 and secured at their lower ends to the sill member 16 by appropriate fasteners 26, with the edges of the adjacent corrugated sheets overlapping each other.

It will be observed that prior art storm shutters of the type illustrated in FIGS. 1–4 and discussed above are totally opaque when installed over a window, door or similar opening, preventing occupants of a building from looking outward through the opening and blocking light from entering the opening. Since storm shutters are often installed hours before arrival of a meteorological disturbance, the blockage of vision and light through the opening has a depressive effect on occupants of a building on which the shutters are installed and also prevents the occupants from visually monitoring an approaching disturbance or anything else outside the building.

Other prior art systems (not illustrated) have attempted to obviate the problem created by opaque corrugated metal storm shutters by providing fully transparent storm shields or shutters intended to cover windows, doors and similar openings in a building. However, these attempts have not proven to be satisfactory in all respects due to the inherent flexibility of transparent panels, which are typically made of a plastic material, and other problems associated with plastic materials. The lack of structural rigidity of such panels poses problems that tend to make them impractical for installation as protective shutters over window and door areas of a building, particularly larger openings. Rigid specifications mandating impact resistance to wind driven objects and wind forces, as well as maximum deflection on impact by flying objects present a challenge to adapting large plastic panels to storm shutter applications.

In accordance with one embodiment of the present invention, and as illustrated in FIGS. 5–8, a storm shutter 27 is made of a plurality of corrugated sheet panels 28,30 vertically oriented adjacent each other in a generally common transverse plane (at least at the panel edges) with a space or gap between adjacent edges of the corrugated panels. The panels 28,30 may extend vertically between a sill member 32 and a header member 34 in a manner similar to the prior art panels illustrated in FIGS. 1–4 when installed on a building. The sill and header members, of course, typically would be secured to the building with an appropriate spacing between the members so as to accommodate the panels 28 and 30. In a typical installation, a plurality of corrugated panels such as 28,30 may be used to construct the storm shutter.

Between the adjacent edges of the panels 28 and 30 and generally spanning the gap between them without overlap there is provided a transparent protective, impact resistant, sheet panel secured to the respective adjacent edges of the corrugated panels 36 of uniform cross-section 28 and 30 by connector members 38,40. FIG. 7 illustrates the configuration of the connector member 38 in more detail. In this embodiment, connector members 38 and 40 are identical in configuration, with one member being inverted with respect to the other member.

As illustrated in FIG. 7, a typical and exemplary connector member 38 includes a main body portion 42 which, in accordance with this embodiment, is a generally open-sided, channel-shaped member including side panels 44,46 and a center panel 48. The panels 44,46 and 48, as will be 5 apparent from viewing FIGS. 6 and 8, are configured so that they will fit in a nesting, close fitting relationship with the adjacent end corrugation 50,52 of corrugated panels 28,30 in contiguous relationship therewith.

Connecting member 38 also includes a continuous edge portion 54 that also is open-sided and preferably channel-shaped so as to receive an edge of transparent sheet panel member 36, as illustrated in FIGS. 6 and 8. It will be observed from FIG. 8 that the open side of the channel formed by edge portion 54 extends generally away from main body portion 42 in an imaginary or hypothetical plane spanning the open side of the main body portion 42 of the channel member and extending generally parallel to the direction of the panel 36 that is received in the channel of edge portion 54. While the corrugated sheets 28,30 and transparent panel 36 form a flat shutter in this illustrative embodiment, the shutter could be curved as well, in which case the connector members 38 would be configured to accommodate the curvature of the shutter and any angles that may exist between the corrugated and transparent panels. Whether the shutter is planar or curved, however, it is desirable to align the adjacent panel edges as closely as practical in a single plane to enhance the overall appearance of the shutter.

In practice, connector member 38 typically is formed as an extrusion from aluminum or other relatively rigid metal material, although any suitable rigid metal or plastic material having an appropriate configuration could be used. The connector members 38 enable transparent panel 36 to be continuously and rigidly connected along its edges to the corrugated panels 28,30 without the need to reconfigure or otherwise alter the adjacent free edges of the corrugated panels 28,30 or the panel 36. The only requirement is that the corrugations 50 and 52 constituting the adjacent edges of the panels 28,30 adjacent the transparent panel 36 be configured so that an overlapping, contiguous fit is obtained between the corrugations 50,52 and the main body portion 42 or the connector members 38. By so connecting the main body portion 42 to a corrugation, the overlapping connection between the transparent panel 36 and the corrugated panel is strengthened and the appearance of the shutter is improved.

It will be observed from FIG. 8 that the main body portion 42 of the connector member 38 is configured such that, when the main body portion 42 is connected in overlapping, contiguous relationship with the end corrugations 50,52, the transparent panel 36 will still lie within the space of the header 34 such that the transparent panel 36 will lie in the same general plane as the outer, offset surfaces or edges 39 of the corrugated panels 28,30. In effect, the connector members 38 form an extension of the corrugated panels 28,30 in the transition region between the end corrugations 50,52 and the transparent panel 36. This results in a pleasing overall appearance of the storm shutter formed by the corrugated panels 28,30 and the transparent panel 36 to the extent that the transparent panel appears to lie between spaced corrugations without a severe discontinuity between the corrugations and the transparent panel.

This arrangement of corrugated metal panels and a transparent impact resistant panel or panels rigidly connected to the corrugated metal panels provides a storm shutter that is structurally rigid and yet partially transparent so one inside a building may observe at least part of the view normally observable through the window or opening that is covered by the shutter. The transparent panel also enables light to enter the building through the opening covered by the storm shutter. The rigid, continuous connection between the transparent panel 36, the connector members 38,40 and the corrugations 50,52 provide a rigid connection between the panels that enables the transparent panel in particular to withstand impacts and resist deflection resulting from wind-driven objects typically propelled by a meteorological disturbance that includes high velocity winds as well as the force of the winds themselves.

Fasteners 56 typically are provided to secure the lower edges of the corrugated panels 28,30 to the sill 32. The upper ends of the panels 28,30, as well as the upper ends of connector members 38,40 are retained within the channel shaped header member 34.

It will be noted from FIGS. 6 and 8 that one set of fasteners 56 are used to connect the main body portion 42 or the connector members 38,40 to a corrugation 50,52 of corrugated panels 28,30. This rigidly connects the main body portion 42 of the connector members 38,40 to the adjacent edges of the corrugated panels 28,30.

The corrugated panels 28,30 are typically formed of stainless steel, galvanized steel, aluminum or other appropriate metal capable of meeting existent specifications governing the use of such materials in storm shutters. The transparent protective panel 36 preferably is formed of a substantially transparent impact resistant synthetic plastic material that may be clear or tinted and that is capable of withstanding wind loads and impacts generated by wind driven flying objects, and which does not deteriorate, weaken or discolor significantly when exposed to outside weather and sunlight. For example, polycarbonate sheets having an appropriate thickness such as ¼ inch (6.3 mm.) marketed under the brand names PALSUN® and PALTOUGH® manufactured by Paltough Limited, Ramat Yohanan 30035, Israel would be suitable. Other transparent polycarbonate synthetic resin materials such as, for example, LEXAN® made by DuPont also may be used.

Channel-shaped edge portions 54 of connector members 38 may be configured to receive the edges of transparent panel 36 in a friction-fit relationship or, alternatively, fasteners 58 may be utilized to retain the edge of the transparent panel 36 in the edge portion 54 of the connector member 38,40. Also, an adhesive bonding material may be utilized in a manner shown in FIG. 6 to retain the opposed edges of the transparent panel 36 in the channels of the edge portion 54 of connector members 38,40. The choice of using the above exemplary or other forms of retainers, of course, will depend upon the physical characteristics of the transparent panel 36 as well as the specification or other objectives that must be met by the panel assembly when installed.

The embodiment in accordance with FIGS. 5–8 illustrates a relatively narrow transparent panel extending between adjacent corrugations of corrugated panels 28,30. However, it is to be understood that the width dimension of the transparent panel 36 may be enlarged to any practical and desired extent consistent with the ability of the panel to withstand wind loads and impacts from flying objects and to otherwise meet desired specifications and objectives of the storm shutter when installed. In any event, in accordance with the preferred embodiment of the invention, the width dimension of the transparent panel 36 will be selected such that the connector members 38,40 can conveniently overlap an edge corrugation of the panels 28,30, as illustrated in FIGS. 6 and 8. This overlapping relationship between the connector members 28,30 and the corrugations 50,52 in effect provide a doubling of the sheet metal of the corrugated panel along the edge of the transparent panel 36 to provide increased rigidity and support for the transparent panel 36 along the edges of the corrugated panel 28,30.

When installed, it is generally preferable to locate the transparent panel 36 spaced away from the adjacent window or door to be protected to take into account possible limited deflection of the transparent panel under impact or wind force loads. Accordingly, as viewed in FIG. 6, the window or opening would be located towards the top of this view which would correspond to the inner side of the shutter illustrated. This results in the transparent panel 36 being located towards the outside of the shutter rather than the inside where it could possibly be located too close to a glass panel to be protected by the shutter.

While the edge portion 54 of the connector member 38 is shown configured as an open-sided channel, it is to be understood that the specific configuration of the edge portion 54 could be varied to meet various needs and to continuously abut an edge of a transparent panel 36 in a rigid, supporting relationship, with or without a separate fastener. The open sided channel, of course, provides distinct advantages and results in enhanced strength of the connection between the transparent panel 36, the connector members 38,40 and the corrugations 50,52.

Although panels 28,30 are illustrated as having alternating offset or displaced channels that provide the corrugated configuration, it is to be understood that the term "corrugated" implies any shape or form that provides inherent structural stiffening of a panel formed of relatively thin sheet metal. Various curved or bent geometric designs, including arcuately curved, could be used.

If desired, additional structural reinforcements in the form of laterally extending rods or bars could be provided mid-span or at other vertical locations between the sill member 32 and header member 34 connected to the spaced corrugations by appropriate fasteners. Such additional reinforcement would be appropriate for large spans of storm shutters that are large, both in a vertical sense as well as a span-wise or width sense.

It will be understood that the main body portions 42 of connector members 38,40 will be configured and geometrically shaped to closely match the geometric configuration of the corrugations 50,52 of panels 28,30. The illustrated configurations of the main body portions 42 of connector members 38,40 is illustrative only and is intended to show how a close, overlapping fit can be obtained between an end corrugation 50,52 and the main body portion 42 of the connector members 38,40.

Figure 12:
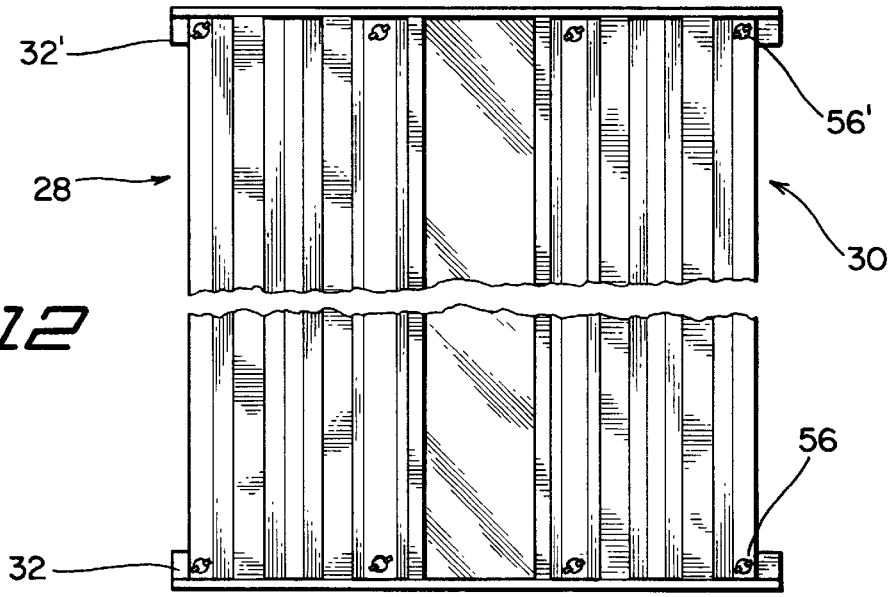
FIG. 12 is an elevation view showing an alternate embodiment of the invention.

If desired, the upper ends of the panels 28,30 may be secured by mechanical fasteners within the header member 34 to provide additional structural rigidity to the storm shutter system. However, the use of fasteners at the upper ends of the panels 28,30 will be facilitated if the header member is configured like the sill member 32, as illustrated, for example, in FIG. 12, where the header 32' is configured like the sill member 32. Fasteners 56' are provided at the upper ends of panels 28,30 to secure the panels to the upper header member 32'.

Figure 10:
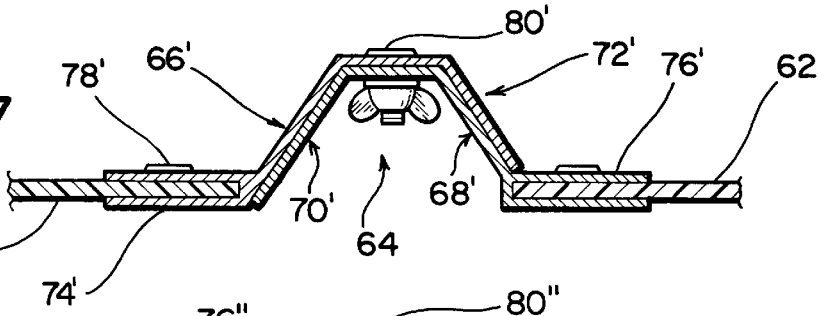
Figure 11:
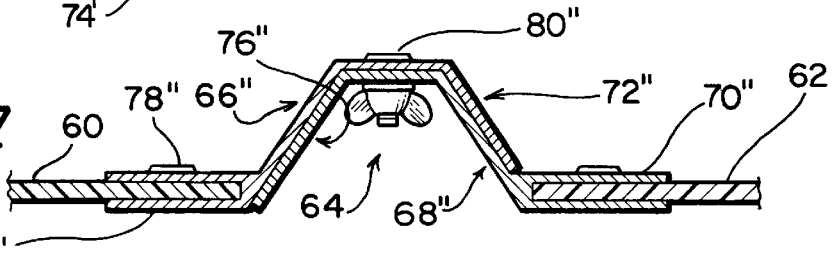

Alternate embodiments of a storm shutter constructed in accordance with the invention are illustrated in FIGS. 9–11, wherein the shutter is made of laterally spaced planar transparent impact resistant protective sheet panels 60,62 having a uniform cross-section and located in laterally spaced apart relationship so as to leave a gap 64 between the adjacent edges of the transparent panels and connector members 66,68 including main body portions 70,72 extending continuously along the connector members. The connector assemblies each include a channel-shaped, panel receiving edge portion 74,76 that receives the edge of a transparent panel 60,62. Fasteners 78 may be utilized optionally to retain the edges of the panels 60,62 in the edge portions 74,76 of retainer members 66,68.

The main body portions 70,72 of the connector members 66,68 are configured so as to fit together in a contiguous, complementary relationship as illustrated in FIGS. 9–11. However, a particular configuration of each connector member 62,68 may be varied as illustrated in FIGS. 9, 10 and 11.

Given that it is highly desirable to maintain the laterally spaced panels 60,62 in substantially a single plane (at least along their edges), the shapes of the main body portions 66,68 may need to be varied so that there is provided, in effect, a "left" connector member and "right" connector member that must be used between adjacent transparent panels 60,62. Thus, the main body portions 66,68 in FIG. 9 will include side panels that extend away from the plane of the panels 60,62 a predetermined distance to enable the edges of the panels to be supported in a common plane while, in FIGS. 10 and 11, the side panels of the main body portions 70' and 72' and 70",72" will need to be varied in accordance with the configuration of the main body portions 66',68' and 66",68". It will be noted also that the configuration of the edge portions 76' and 76" may be varied in configuration to enable the continuous overlapping contiguous fit between the main body portions 70',72' and 70",72".

Suitable fasteners 80,80',80" may be utilized to secure the main body portions 70,72; 70',72'; and 70",72" together in a tight fitting relationship.

The edge portions 74,76; 74',76' and 74",76" typically extend in a direction parallel to an imaginary or hypothetical plane including the transparent protective panels 60,62, or outside an imaginary line extending between the panel side edges; which plane also will span the open side of the main body portions 70,72; 70',72'; and 70",72". All of the edge portions are illustrated as extending away from the main body portions of the connecting members but it is to be understood that, in the event that the storm shutter is configured as a curved panel, it may be desirable to change the angle of the edge portions of the connector members so that they may receive the adjacent edges of the transparent panels freely without the need to bend the connector members to form a curved storm shutter.

Of the embodiments illustrated in FIGS. 9, 10 and 11, the embodiment of FIG. 10 is preferred in practice. The lateral widths of the transparent panels may be varied across the shutter if desired, and corrugated sheet metal panels may be used or omitted in accordance with design specifications.

Figure 13:
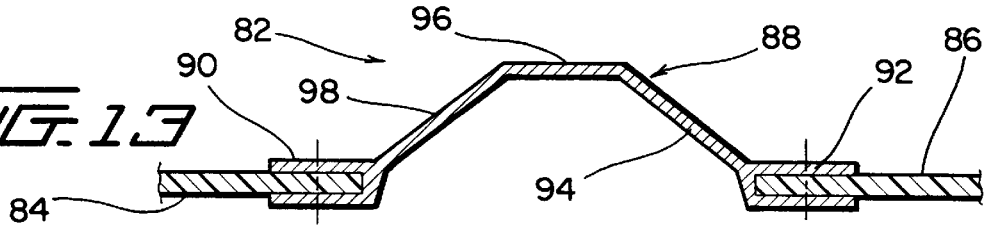
FIG. 13 is a sectional view showing another alternate embodiment of the invention.

Another alternate embodiment of the invention is illustrated in FIG. 13, where a single connector member 82 is used to connect transparent panels 84,86 together in a shutter system that may include a series of transparent panels or a combination of transparent panels and corrugated sheet metal panels. The connector member 82 in this embodiment includes a main body portion 88 and edge portions 90,92, the main body portion 88 being constituted of panels or sections 94, 96 and 98 which, in this embodiment, are shown as planar sections but which may be curved or formed in a different configuration.

Like the embodiment of connector member 80 in FIG. 9, the main body portion 88 is bent out of the plane that includes adjacent edges of transparent panels 84,86 that are connected to edge portions 90,92 of connector member 82. Fasteners (not illustrated) may be used to secure the transparent panels 84,86 in edge portions 90,92, if desired. In accordance with this embodiment, a single thickness of connector member material is utilized to form connector member 82, although the main body portion 88 may have an additional thickness or reinforcement depending upon the strength required for the connector member 82. The main body portion 88, as seen in FIG. 13, is curved or bent out of the plane including the adjacent edges of transparent panels 84,86 to provide reinforcement against bending loads and, if desired, to present an attractive appearance.

Obviously, the double thickness reinforcement provided by the embodiments illustrated in FIGS. 9–11 will present distinct advantages in terms of strength and resistance against bending loads and will also provide advantages in terms of ease of assembly of the shutter.

It will be understood that the various embodiments illustrated in the drawings and described herein are intended to be exemplary only and to comply with the written disclosure requirements of the patent laws. It will be understood that the scope of protection for the invention is not limited to the specific embodiments illustrated but extends to the full scope and meaning of the claims that follow.

What is claimed is:

1. A partially transparent storm shutter for protecting a glass window, door and similar opening of a building, comprising:

at least two spaced-apart, laterally adjacent corrugated sheet metal panels terminating at continuous corrugations extending along adjacent panel edges;

a protective, transparent, impact resistant sheet panel of uniform cross-section having opposed continuous edges conforming in cross-section to the transparent panel and terminating adjacent the metal panel edges without overlap with said metal panel edges and disposed between said metal panel edges;

a connector member rigidly and continuously connecting each opposed edge of the transparent panel to a corrugation of an adjacent edge of a corrugated metal panel, said connector member spanning the distance between the metal panel edge and the opposed edge of the transparent panel;

said connector members each including a first and second portion having contours conforming to and overlapping an adjacent corrugation of the sheet metal panel edge, a third panel arranged to span the distance between the metal panel edges and the opposed edges of the transparent panel and a fourth portion engaging and secured to the transparent panel edge, said fourth portion being channel-shaped to receive a transparent panel edge in close-fitting relationship and extending in the direction of the transparent panel; and connectors rigidly securing the first and second portions of the connector members against separation from the metal panel edges and causing the first and second portions of the connector members to be maintained in overlapping relationship with adjacent corrugations of the corrugated metal panel edges.

2. A partially transparent storm shutter for protecting a glass window, door and similar opening of a building, comprising:

a plurality of flat, laterally adjacent transparent, protective, impact resistant, uniform cross-section sheet-like panels spaced apart from each other along adjacent edges to leave a gap extending between adjacent transparent panel edges, said transparent panel edges having cross-sections corresponding to the transparent panel cross-sections;

first and second connector members spanning each gap between adjacent transparent panel edges, each member including a channel receiving a transparent panel edge and rigidly secured to such edge in close-fitting relationship;

said members further each comprising a main body portion spanning at least part of the gap between adjacent transparent panels;

said main body portions each being configured to extend at least partially outside an imaginary straight line extending between the transparent panel side edges and to overlap each other in contiguous relationship at an area separated from said imaginary straight line;

said main body portions being rigidly secured together along an overlapping area between them.

* * * * *